US005273510A

United States Patent [19]

Puckett et al.

[11] Patent Number: 5,273,510

[45] Date of Patent: Dec. 28, 1993

[54] EXERCISE AID

[75] Inventors: Thomas R. Puckett, 2608 Abbey Rd., Oklahoma City, Okla. 73120; Johnny G. Roby, Oklahoma City, Okla.

[73] Assignee: Thomas R. Puckett, Oklahoma City, Okla.

[21] Appl. No.: 960,500

[22] Filed: Oct. 9, 1992

[51] Int. Cl.[5] ..... A63B 26/00

[52] U.S. Cl. ..... 482/142; 482/148; 5/630; 5/633

[58] Field of Search ..... 5/630, 633; 297/284; 602/19; 482/142, 72, 148

[56] References Cited

U.S. PATENT DOCUMENTS 1,934,918 8/1931 Everson ..... 5/630
3,305,878 2/1967 Hellbaum ..... 5/630
3,587,569 6/1971 Madsen ..... 297/284.1
4,705,268 11/1987 Nadean ..... 482/72
5,018,790 5/1991 Jay ..... 297/284.1

*Primary Examiner*—Richard J. Apley
*Assistant Examiner*—Lynne A. Reichard
*Attorney, Agent, or Firm*—Dunlap, Codding & Lee

[57] ABSTRACT

An exercise aid for use by individuals which is adapted to be supported on a support surface such as a floor. The exercise aid comprises a pad assembly having a pad channel formed through an upper surface and extending a distance through the pad assembly through the lower surface. The individual sits on the upper surface of the pad assembly with the individual's spine being about aligned with the pad channel and the lower surface of the pad being disposed on the support surface.

23 Claims, 1 Drawing Sheet

EXERCISE AID

FIELD OF THE INVENTION

The present invention relates generally to exercise aids and, more particularly, but not by way of limitation, to a pad assembly having a pad channel formed through an upper surface thereof.

DESCRIPTION OF THE PREFERRED EMBODIMENTS

Figure 1:
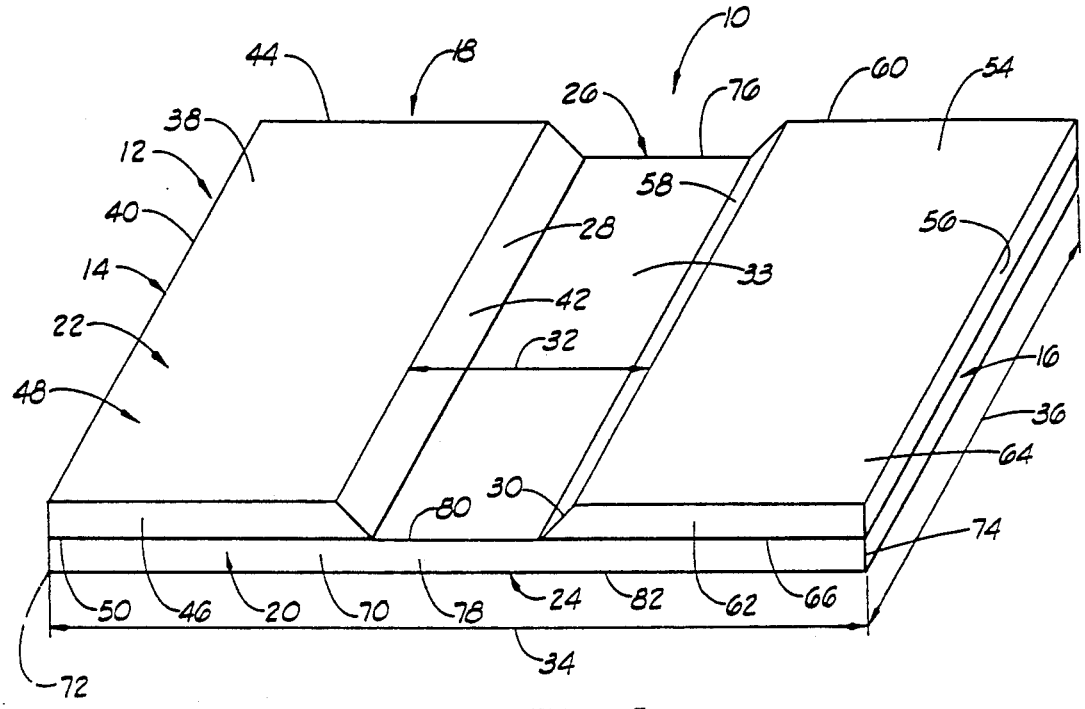
FIG. 1 is a perspective view of a pad assembly constructed in accordance with the present invention.
Figure 2:
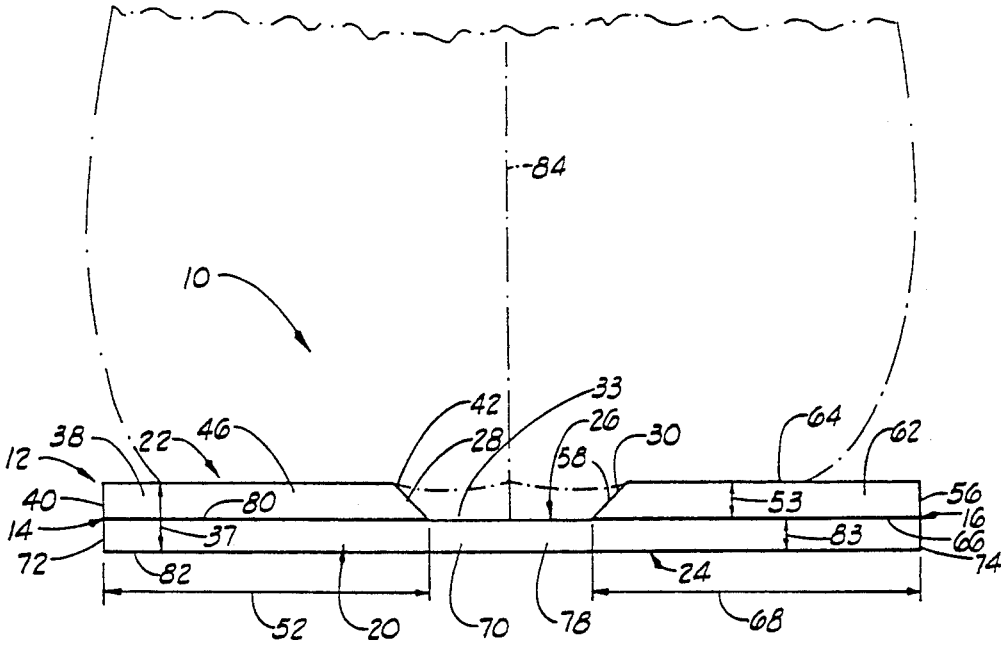
FIG. 2 is a side elevational view of the pad assembly of FIG. 1 showing a portion of an individual in dashed lines sitting on the pad assembly.

Shown in FIGS. 1 and 2 is an exercise aid 10 constructed in accordance with the present invention. The exercise aid 10 comprises a pad assembly 12 having a first end 14, a second end 16, a first side 18, a second side 20, an upper surface 22 and a lower surface 24.

A pad channel 26 is formed through a portion of the upper surface 22 and the pad channel 26 extends a distance through the upper surface 22 of the pad assembly 12 toward the lower surface 24 of the pad assembly 12. The pad channel 26 extends between the first and the second sides 18 and 20 of the pad assembly 12. More particularly, the pad channel 26 extends across the pad assembly 12 intersecting the first and the second sides 18 and 20. The pad channel 26 is disposed about mid-way between the first and the second ends 14 of the pad assembly 12.

The pad channel 26 forms a first channel wall 28 in the pad assembly 12 extending between the first and the second sides 18 and 20. The pad channel 26 also forms a second channel wall 30 extending between the first and the second sides 18 and 20. The first channel wall 28 is beveled and formed at an angle and extends angularly downwardly from the upper surface 22 toward the lower surface 24 and angularly toward the second end 16 of the pad assembly 12. The second channel wall 30 is beveled and extends angularly downwardly from the upper surface 22 toward the lower surface 24. A second channel wall 30 extends angularly downwardly from the upper surface 22 toward the first end 14 of the pad assembly 12. The first channel wall 28 extends angularly toward the second channel wall 30 and the second channel wall 30 extends angularly toward the first channel wall 28.

The channel wall 28 is spaced a distance from the second channel wall 30 forming a channel width 32 (FIG. 1). The pad channel 26 extends downwardly through the pad assembly 12 terminating with a channel support surface 33. The channel support surface 33 extends between the first and the second sides 18 and 20 of the pad assembly 12 and between the first and the second channel walls 28 and 30. The first channel wall 28 extends in a plane about parallel with the planar disposition of the second channel wall 30.

The pad assembly 12 has a pad length 34 (FIG. 1) which extends generally between the first and the second ends 14 and 16 of the pad assembly 12. The pad assembly 12 has a pad width 36 (FIG. 1) which extends generally between the first and the second sides 18 and 20 of the pad assembly 12. The pad assembly 12 has a pad thickness 37 (FIG. 2) which extends generally between the upper and the lower surfaces 22 and 24 of the pad assembly 12.

The pad assembly 12 includes a first upper pad 38. The first upper pad 38 has a first end 40, a second end 42, a first side 44, a second side 46, an upper surface 48 and a lower surface 50. The first upper pad 38 has a first upper pad length 52 (FIG. 2) extending generally between the first and the second ends 40 and 42. The first upper pad 38 has a first upper pad width extending generally between the first and the second sides 44 and 46 of the first upper pad 38 with the first upper pad width being about equal to the pad width 36. The first upper pad 38 has a first upper pad thickness 53 (FIG. 2) extending between the upper surface 48 and the lower surface 50 of the first upper pad 38.

The pad assembly 12 includes a second upper pad 54. The second upper pad 54 has a first end 56, a second end 58, a first side 60, a second side 62, an upper surface 64 and a lower surface 66. The second upper pad 54 has a second upper pad length 68 (FIG. 2) extending generally between the first and the second ends 56 and 58. The first upper pad 54 has a first upper pad width extending generally between the first and the second sides 60 and 62 of the first upper pad 54 with the first upper pad width being about equal to the pad width 36. The second upper pad 54 has a first lower pad thickness 69 (FIG. 2) extending between the upper surface 64 and the lower surface 66 of the first upper pad 54.

The pad assembly 12 also includes a lower pad 70. The lower pad 70 has a first end 72, second end 74, first side 76, a second side 78, an upper surface 80 and a lower surface 82. The lower pad 70 has a lower pad thickness 83 extending generally between the upper surface 80 and the lower surface 82 of the lower pad 70. The lower pad 70 has a lower pad length extending generally between the first and the second ends 72 and 74 about equal to the pad length 34. The lower pad 70 has a pad width extending between the first and the second sides 76 and 78 about equal to the pad width 36. The lower pad 70 has a pad thickness 83 (FIG. 2) extending between the upper surface 80 and the lower surface 82.

The first upper pad 38 is disposed on the lower pad 70 with the lower surface 50 of the first upper pad 38 being disposed adjacent the upper surface 80 of the lower pad 70. In this assembled position, the first end 40 of the first upper pad 38 is aligned with the first end 72 of the lower pad 70, the first side 44 of the first upper pad 38 is aligned with the first side 76 of the lower pad 70 and the second side 46 of the first upper pad 38 is aligned with the second side 78 of the lower pad 70. In this assembled position, the first upper pad 38 is secured to the lower pad 70 by bonding the first upper pad 38 to the lower pad 70 with an adhesive or any other suitable bonding material. The first channel wall 28 more particularly is formed on the second end 42 of the first upper pad 38.

The second upper pad 54 is disposed on the lower pad 70 with the lower surface 66 of the second upper pad 54 being disposed adjacent the upper surface 80 of the lower pad 70. In this assembled position, the first end 56 of the second upper pad 54 is aligned with the second end 74 of the lower pad 70, the first side 60 of the second upper pad 54 is aligned with the first side 76 of the lower pad 70 and the second side 62 of the second upper pad 54 is aligned with the second side 78 of the lower pad 70. The second channel wall 30 more particularly is formed on the second end 58 of the second upper pad 54. The space between the first upper pad 38 and the second upper pad 54 forms the pad channel 26 with the portion of the upper surface 80 of the lower pad 70 disposed between the first and the second upper pads 38 and 54 forming the channel support surface 33 extending between the first and the second channel walls 28 and 30.

In one preferred embodiment, the pad length 34 is about 30.48 cm, the pad width 36 is about 27.94 cm and the pad thickness 37 is about 2.2225 cm. The channel width 32 is about 7.62 cm at the top edge of the pad channel 26 adjacent the upper surface 22 of the pad assembly 12 and the channel width at the bottom edge adjacent the channel support surface 33 is about 6.35 cm. In this embodiment, the first and the second channel walls 28 and 30 each angularly extend at about 45 degrees. In this embodiment, the first upper pad 38 is shaped about identical with the second upper pad 64. The first upper pad length 52 is about 11.43 cm and the second upper pad length 68 is about 11.43 cm. The upper pad thickness 53 is about 1.27 cm and the lower pad thickness 69 is about 0.9525 cm.

The first and the second upper pads 38 and 54 each are constructed of a resilient, elastomeric material. The first and the second upper pads 38 and 54 each are constructed of a relatively dense material as compared to the density of the lower pad 70 and the first and the second upper pads 38 and 54 each have a compression deflection factor which is more than the compression deflection factor of the lower pad 70. In the preferred embodiment described before, the first and the second upper pads 38 and 54 preferably are constructed of a styrene butadiene rubber commercially available from Rubatex Corporation, Bedford, Va., Model Numbers R-8511-S through R-8525-S. This product has a compression deflection of 5 to 13 PSI. This lower pad 70 preferably is constructed of ethylene vinyl acetate and is commercially available from Rubatex Corporation, Bedford, Va., Model Numbers R-5010-A, R-5011-A, R-5012-A, R-5013-A or R-5014-A. In both cases this product has a compression deflection of about 2 to 5 PSI.

The purpose of having the two different materials for the first and the second upper pads 38 and 54 and the lower pad 70 is to disperse load forces through the top layers (the first and the second upper pads 38 and 54) of dense material into a larger area of the less dense bottom layer (lower pad 70). This results in a comfortably soft exercise base that retains a firm and stable feeling in use. The lower pad 70 also frictionally engages the support surface (floor) during use.

In use, an individual disposes the pad assembly 12 on a support surface (floor) with the lower pad 70 being adjacent the support surface. The individual then sits on the upper surface 22 of the pad assembly 12 with the individual facing either the first side 18 or the second side 20 of the pad assembly 12. In this position, the left rear muscle (gluteus maximus) of the individual is disposed on either the first upper pad 38 or the second upper pad 54 and the right rear muscle (gluteus maximus) of the individual is disposed on the opposite first or second upper pad 38 or 54 with the first and second upper pads 38 and 54 support the rear of the individual above the channel support surface 33 so that, in use, generally no portion of the individual is supported on the channel support surface 33, the individual's spine being disposed about along a spine center line 84 (FIG. 2) which is about aligned with a centerline of the pad channel 26 extending between the first and the second sides 18 and 20 of the pad assembly 12.

The individual lies in a supine position with the pad assembly 12 under the individual's hips. The pad channel 26 runs about parallel with the axis of the individual's spine. The left rear muscle (gluteus maximus) is supported on one side of the pad channel 26 and the right rear muscle (gluteus maximus) is supported on the opposite side of the pad channel 26.

The individual then performs various exercises such as sit ups, crunches or leg lifts. The pad assembly 12 slightly elevates the individual's pelvic girdle during such exercises thereby relieving stresses associated with the movements. The presence of the pad channel 26 reduces discomfort caused by friction from pelvic/coccygeal rotation during such exercises. Friction and stresses normally encountered during exercises are substantially reduced using the pad assembly 12 so that the exercises may be performed with less discomfort.

It also has been found that the pad assembly 12 may be used as a lower back support such as for use in a chair like a dental chair for instance. In this position, the lower pad 70 is placed adjacent the chair back and the individual sits on the chair seat with the individual's back disposed adjacent the upper surface 22 of the pad assembly 12. In this position, the individual's spine is disposed in the pad channel 26.

Changes may be made in the construction and the operation of the various components, elements and assemblies described herein and changes may be made in the steps or the sequence of steps of the methods described herein without departing from the spirit and scope of the invention as defined in the following claims.

What is claimed is:

1. An exercise aid adapted for use by an individual having a spine and adapted to be disposed on a support surface comprising:

a pad assembly having an upper surface and a lower surface with a pad channel being formed through the upper surface and extending a distance through the pad assembly toward the lower surface terminating with a channel support surface, the pad assembly comprising:

a first upper pad having a first end, a second end, a first side, a second side, an upper surface and a lower surface;

a second upper pad having a first end, a second end, a first side, a second side, an upper surface and a lower surface; and a lower pad having a first end, a second end, a first side, a second side, an upper surface and a lower surface, the first upper pad being disposed on the lower pad with the lower surface of the first upper pad being disposed adjacent the upper surface of the lower pad, and the second upper pad being disposed on the lower pad with the lower surface of the second upper pad being disposed adjacent the upper surface on the lower pad, the second end of the first upper pad being spaced a distance from the second end of the second upper pad and the distance between the first and the second upper pads forming the pad channel with the portion of the lower pad disposed between the first and the second upper pads forming the channel support surface, the second end of the first upper pad forming a first channel wall and the second end of the second upper pad forming a second channel wall, the lower surface of the lower pad being shaped to be disposed on the support surface and the upper surfaces of the first and the second upper pads each being shaped and positioined on the lower pad so that an individual sits on the upper surfaces of the first and the second upper pads with the individual's spine being aligned with the pad channel and the individual's left rear muscle being supported on the first upper pad and the individual's right rear muscle being supported on the second upper pad with the first and the second upper pads being sized so that the individual is supported above the channel support surface.

2. The exercise aid of claim 1 wherein the first channel wall is defined further as extending angularly from the upper surface of the first upper pad angularly toward the lower surface of the first upper pad, and wherein the second channel wall is defined further as extending angularly from the upper surface of the second upper pad toward the lower surface of the second upper pad.

3. The exercise aid of claim 1 wherein the first channel wall is defined further as extending angularly toward the second channel wall and wherein the second channel wall is defined further as extending angularly toward the first channel wall.

4. The exercise aid of claim 1 wherein the first end of the first upper pad is aligned with the first end of the lower pad, the first side of the first upper pad is aligned with the first side of the lower pad and the second side of the first upper pad is aligned with the second side of the lower pad, and wherein the first end of the second upper pad is aligned with the second end of the lower pad, the first side of the second upper pad is aligned with the first side of the lower pad and the second side of the second upper pad is aligned with the second side of the lower pad.

5. The exercise aid of claim 1 wherein the first and the second upper pads each are constructed of an elastomeric material having a compression deflection of about 5 to about 13 PSI, and wherein the lower pad is defined further as being constructed of the elastomeric material having a compression deflection of about 2 to about 5 PSI.

6. An exercise aid adapted for use by an individual having a spine and adapted to be supported on a support surface comprising:

a lower pad having a first end, a second end, a first side, a second side, an upper surface and a lower surface;

a first upper pad having a first end, a second end, a first side, a second side, an upper surface and a lower surface, the first upper pad being disposed on the lower pad with the lower surface of the first upper pad being disposed adjacent the upper surface of the lower pad, the first end of the first upper pad being aligned with the first end of the lower pad, the first side of the first upper pad being aligned with the first side of the lower pad and the second side of the first upper pad being aligned with the second side of the lower pad, the second end of the first upper pad being spaced a distance from the second end of the lower pad;

a second upper pad having a first end, a second end, a first side, a second side, an upper surface and a lower surface, the second upper pad being disposed on the lower pad with the first end of the second upper pad being aligned with the second end of the lower pad, the first side of the second upper pad being aligned with the first side of the lower pad, the second side of the second upper pad being aligned with the second side of the lower pad and the second end of the second upper pad being spaced a distance from the second end of the first upper pad with the space between the second end of the first upper pad and the second end of the second upper pad forming a pad channel and the upper surface of the lower pad disposed between the first and second upper pads forming a channel support surface, and the second end of the first upper pad forming a first channel wall and the second end of the second upper pad forming a second channel wall, the first channel wall extending angularly from the upper surface of the first upper pad toward the lower surface of the first upper pad at an angle toward the second end of the second upper pad and the second channel wall extending at an angle from the upper surface of the second upper pad toward the lower surface of the second upper pad with the second channel wall extending at an angle toward the first channel wall, the upper surfaces of the first and second upper pads being shaped and positioned to support the individual sitting on the upper surfaces of the first and the second upper pads with the first and the second upper pads each being adapted and shaped for supporting the individual's left rear muscle on one of the first and the second upper pads and the individual's right rear muscle on the opposite first or second upper pad and with the individual's spine being aligned with a center line of the pad channel, and the first and the second upper pads cooperating to support the individual above the channel support surface.

7. The exercise aid of claim 6 wherein the first and the second upper pads each are defined further as being constructed of an elastomeric material having a compression deflection of about 5 to about 13 PSI and wherein the lower pad is defined further as being constructed of the elastomeric material having a compression deflection of about 2 to about 5 PSI.

8. An exercise method for in individual performing exercises comprising:

providing a pad assembly having an upper surface and a lower surface with a pad channel being formed through the upper surface and extending a distance through the pad assembly toward the lower surface terminating with a channel support surface;

disposing the pad assembly on a support surface with the lower surface of the pad assembly being disposed on the support surface;

sitting by an individual on the upper surface of the pad assembly with the individual's left rear muscle being supported on one side of the pad channel and the individual's right rear muscle being supported on the opposite side of the pad channel and with the individual's spine being aligned with a centerline of the pad channel, and with the individual being supported above the channel support surface; and performing by the individual the exercises while remaining sitting on the pad assembly.

9. The method of claim 8 wherein the step of providing the pad assembly is defined further as providing the pad assembly as having a first end, a second end, a first side and a second side and wherein the pad channel is defined further as extending between the first and the second sides of the pad assembly and being disposed between the first and the second ends of the pad assembly.

10. The method of claim 8 wherein the steps of providing the pad assembly is defined further as providing the pad assembly having the pad channel with a first and a second channel wall in the pad assembly, the first channel wall being beveled and extending a distance angularly from the upper surface toward the lower surface and the second channel wall being beveled and extending a distance angularly from the upper surface toward the lower surface.

11. The method of claim 8 wherein the step of providing the pad assembly is defined further as providing the pad assembly with the first channel wall extending a distance angularly toward the second channel wall, and the second channel wall extending a distance angularly generally toward the first channel wall.

12. The method of claim 8 wherein the step of providing the pad assembly is defined further as providing the pad assembly comprising:

a first upper pad having a first end, a second end, a first side, a second side, an upper surface and a lower surface, the first channel wall being formed on the second end of the first upper pad;

a second upper pad having a first end, a second end, a first side, a second side, an upper surface and a lower surface, the second channel wall being formed on the second end of the second upper pad; and a lower pad having a first end, a second end, a first side, a second side an upper surface and a lower surface, the first upper pad being disposed on the lower pad with the lower surface of the first upper pad being disposed adjacent the upper surface of the lower pad, and the second upper pad being disposed on the lower pad with the lower surface of the second upper pad being disposed adjacent the upper surface on the lower pad, the second end of the first upper pad being spaced a distance from the second end of the second upper pad and the distance between the first and the second upper pads forming the pad channel with the portion of the lower pad disposed between the first and the second upper pads forming the channel support surface, the second end of the first upper pad forming a first channel wall and the second end of the second channel pad forming a second channel wall.

13. The method of claim 12 wherein the step of providing the pad assembly further comprises providing the pad assembly with the first channel wall extending angularly from the upper surface of the first upper pad angularly toward the lower surface of the first upper pad, and with the second channel wall extending angularly from the upper surface of the second upper pad toward the lower surface of the second upper pad.

14. The method of claim of claim 13 wherein the step of providing the pad assembly is defined further as providing the pad assembly with the first channel wall extending angularly toward the second channel wall and with the second channel wall extending angularly toward the first channel wall.

15. The method of claim 13 wherein the step of providing the pad assembly is defined further as providing the pad assembly with the first end of the first upper pad aligned with the first end of the lower pad, the first side of the first upper pad aligned with the first side of the lower pad and the second side of the first upper pad aligned with the second side of the lower pad, and the first end of the second upper pad aligned with the second end of the lower pad, the first side of the second upper pad aligned with the first side of the lower pad and the second side of the second upper pad aligned with the second side of the lower pad.

16. The method of claim 15 wherein the step of providing the pad assembly is defined further as providing the pad assembly with the first and the second upper pads constructed of an elastomeric material having a compression deflection of about 5 to about 13 PSI, and with the lower pad constructed of an elastomeric material having a compression deflection of about 2 to about 5 PSI.

17. An exercise aid adapted for use by an individual having a spine and adapted to be disposed on a support surface comprising:

a pad assembly having an upper surface and a lower surface with a pad channel being formed through the upper surface and extending a distance through the pad assembly toward the lower surface terminating with a channel support surface, the pad assembly comprising:

a first upper pad having a first end, a second end, a first side, a second side, an upper surface and a lower surface;

a second upper pad having a first end, a second end, a first side, a second side, an upper surface and a lower surface; and a lower pad having a first end, a second end, a first side, a second side, an upper surface and a lower surface, the first upper pad being disposed on the lower pad with the lower surface of the first upper pad being disposed adjacent the upper surface of the lower pad, and the second upper pad being disposed on the lower pad with the lower surface of the second upper pad being disposed adjacent the upper surface on the lower pad, the second end of the first upper pad being spaced a distance from the second end of the second upper pad and the distance between the first and the second upper pads forming the pad channel with the portion of the lower pad disposed between the first and the second upper pads forming the channel support surface, the second end of the first upper pad forming a first channel wall and the second end of the second upper pad forming a second channel wall, the lower surface of the lower pad being shaped to be disposed on the support surface and the upper surfaces of the first and the second upper pads each being shaped and positioined on the lower pad so that an individual sits on the upper surfaces of the first and the second upper pads with the individual's spine being aligned with the pad channel and the individual's left rear muscle being supported on the first upper pad and the individual's right rear muscle being supported on the second upper pad with the first and the second upper pads being sized so that the individual is supported above the channel support surface, the first and the second upper pads each being constructed of an elastomeric material and the lower pad being constructed of an elastomeric material with the first and the second upper pads each having a higher compression deflection as compared to the compression deflection of the lower pad.

18. The exercise aid of claim 17 wherein the first channel wall is defined further as extending angularly from the upper surface of the first upper pad angularly toward the lower surface of the first upper pad, and wherein the second channel wall is defined further as extending angularly from the upper surface of the second upper pad toward the lower surface of the second upper pad.

19. The exercise aid of claim 18 wherein the first channel wall is defined further as extending angularly toward the second channel wall and wherein the second channel wall is defined further as extending angularly toward the first channel wall.

20. The exercise aid of claim 18 wherein the first end of the first upper pad is aligned with the first end of the lower pad, the first side of the first upper pad is aligned with the first side of the lower pad and the second side of the first upper pad is aligned with the second side of the lower pad, and wherein the first end of the second upper pad is aligned with the second end of the lower pad, the first side of the second upper pad is aligned with the first side of the lower pad and the second side of the second upper pad is aligned with the second side of the lower pad.

21. The exercise aid of claim 20 wherein the compression deflection of the first and the second upper pads each is defined further as being about 5 to about 13 psi and wherein the compression deflection of the lower pad is defined further as being about 2 to about 5 psi.

22. An exercise method for an individual performing exercising comprising:

providing a pad assembly having an upper surface and a lower surface with a pad channel being formed through the upper surface and extending a distance through the pad assembly toward the lower surface terminating with a channel support surface, the pad assembly comprising:

a first upper pad having a first end, a second end, a first side, a second side, an upper surface and a lower surface;

a second upper pad having a first end, a second end, a first side, a second side, an upper surface and a lower surface; and a lower pad having a first end, a second end, a first side, a second side, an upper surface and a lower surface, the first upper pad being disposed on the lower pad with the lower surface of the first upper pad being disposed adjacent the upper surface of the lower pad, and the second upper pad being disposed on the lower pad with the lower surface of the second upper pad being disposed adjacent the upper surface on the lower pad, the second end of the first upper pad being spaced a distance from the second end of the second upper pad and the distance between the first and the second upper pads forming the pad channel with the portion of the lower pad disposed between the first and the second upper pads forming the channel support surface, the second end of the first upper pad forming a first channel wall and the second end of the second upper pad forming a second channel wall, disposing the pad assembly on a support surface with the lower surface of the pad assembly being disposed on the support surface;

sitting by an individual on the upper surfaces of the first and second upper pads with the individual's left rear muscle being supported on the upper surface of the first upper pad and the individual's right rear muscle being supported on the upper surface of the second upper pad and with the individual's spine being aligned with the pad channel, and with the individual being supported above the channel support surface; and performing by the individual the exercises while remaining sitting on the pad assembly.

23. An exercise method for an individual performing exercising comprising:

providing a pad assembly having an upper surface and a lower surface with a pad channel being formed through the upper surface and extending a distance through the pad assembly toward the lower surface terminating with a channel support surface, the pad assembly comprising:

a first upper pad having a first end, a second end, a first side, a second side, an upper surface and a lower surface;

a second upper pad having a first end, a second end, a first side, a second side, an upper surface and a lower surface; and a lower pad having a first end, a second end, a first side, a second side, an upper surface and a lower surface, the first upper pad being disposed on the lower pad with the lower surface of the first upper pad being disposed adjacent the upper surface of the lower pad, and the second upper pad being disposed on the lower pad with the lower surface of the second upper pad being disposed adjacent the upper surface on the lower pad, the second end of the first upper pad being spaced a distance from the second end of the second upper pad and the distance between the first and the second upper pads forming the pad channel with the portion of the lower pad disposed between the first and the second upper pads forming the channel support surface, the second end of the first upper pad forming a first channel wall and the second end of the second upper pad forming a second channel wall, disposing the pad assembly on a support surface with the lower surface of the pad assembly being disposed on the support surface;

sitting by an individual on the upper surfaces of the first and second upper pads with the individual's left rear muscle being supported on the upper surface of the first upper pad and the individual's right rear muscle being supported on the upper surface of the second upper pad and with the individual's spine being aligned with the pad channel, and with the individual being supported above the channel support surface; and performing by the individual the exercises while remaining sitting on the pad assembly, the first and the second upper pads each being constructed of an elastomeric material and the lower pad being constructed of an elastomeric material with the first and the second upper pads each having a higher compression deflection as compared to the compression deflection of the lower pad.

* * * * *

UNITED STATES PATENT AND TRADEMARK OFFICE

CERTIFICATE OF CORRECTION

PATENT NO. : 5,273,510

DATED : December 28, 1993

INVENTOR(S) : Thomas R. Puckett, Johnny H. Roby

It is certified that error appears in the above-identified patent and that said Letters Patent is hereby corrected as shown below:

Column 1, Line 33, after ends 14, please insert --and 16--.

Column 3, Line 36, after PSI., please delete "This" and substitute therefore --The--.

Column 5, Line 4; after and, please delete "positioined" and substitute therefore --positioned--.

Column 6, Line 30; after first, please delete "and" and substitute therefore --or--.

Column 6, Line 68; after assembly, please delete "as".

Column 7, line 6; after the, delete "steps" and substitute therefore --steps--.

Column 7, line 34; after second side, please insert --,--.

Column 7, line 41, after surface, delete "on" and substitute therefore --of--.

UNITED STATES PATENT AND TRADEMARK OFFICE

CERTIFICATE OF CORRECTION

PATENT NO. : 5,273,510

DATED : December 28, 1993

INVENTOR(S) : Thomas R. Puckett, Johnny H. Roby

It is certified that error appears in the above-identified patent and that said Letters Patent is hereby corrected as shown below:

Column 7, Line 50, after second, please delete "channel" and substitute therefore --upper--.

Column 8, Line 40, after surface, please delete "on" and substitute therefore --of--.

Column 8, Line 54; after and, please delete "positioined" and substitute therefore --positioned--.

Column 10, Line 37; after surface, please delete "on" and substitute therefore --of--.

Signed and Sealed this

First Day of November, 1994

Bruce Lehman

*Attest:*

BRUCE LEHMAN

*Attesting Officer*

*Commissioner of Patents and Trademarks*